US009937095B2

(12) United States Patent
Hachisuka et al.

(10) Patent No.: US 9,937,095 B2
(45) Date of Patent: Apr. 10, 2018

(54) EXERCISE TRAINING APPARATUS

(71) Applicant: UNIVERSITY OF OCCUPATIONAL AND ENVIRONMENTAL HEALTH, JAPAN, Kitakyushu-shi, Fukuoka (JP)

(72) Inventors: Kenji Hachisuka, Kitakyushu (JP); Futoshi Wada, Kitakyushu (JP); Taiji Oda, Fukuoka (JP); Yoshie Nakanishi, Kitakyushu (JP); Ikuo Yamamoto, Nagasaki (JP); Takunori Tsuji, Fukuoka (JP); Hideyuki Sakoda, Fukuoka (JP)

(73) Assignee: UNIVERSITY OF OCCUPATIONAL AND ENVIRONMENTAL HEALTH, JAPAN, Fukuoka (JP)

( * ) Notice: Subject to any disclaimer, the term of this patent is extended or adjusted under 35 U.S.C. 154(b) by 684 days.

(21) Appl. No.: 14/397,753

(22) PCT Filed: May 8, 2013

(86) PCT No.: PCT/JP2013/062932
§ 371 (c)(1),
(2) Date: Oct. 29, 2014

(87) PCT Pub. No.: WO2013/168738
PCT Pub. Date: Nov. 14, 2013

(65) Prior Publication Data

US 2015/0133828 A1 May 14, 2015

(30) Foreign Application Priority Data

May 9, 2012 (JP) ..... 2012-107830

(51) Int. Cl.
*A61H 1/02* (2006.01)
*A63B 21/00* (2006.01)

(52) U.S. Cl.
CPC ..... *A61H 1/0214* (2013.01); *A61H 1/0285* (2013.01); *A61H 2201/0157* (2013.01);
(Continued)

(58) Field of Classification Search
CPC ..... A61H 1/0214; A61H 1/0285; A61H 2201/1635; A61H 2201/5007;
(Continued)

(56) References Cited

U.S. PATENT DOCUMENTS

2007/0282228 A1* 12/2007 Einav ..... A61B 5/7475 601/33
2010/0217163 A1* 8/2010 Sankai ..... B25J 9/0006 601/5
2011/0137464 A1* 6/2011 Sabater Navarro .. A61H 1/0274 700/264

FOREIGN PATENT DOCUMENTS

JP 2002-210040 A 7/2002
JP 2003-88562 A 3/2003
(Continued)

OTHER PUBLICATIONS

Nishimura et al., "Neural Substrates for the Motivational Regulation of Motor Recovery after Spinal-Cord Injury", PLoS One, Sep. 2011, vol. 6, Issue 9, e24854, pp. 1-8.
(Continued)

*Primary Examiner* — Quang D Thanh
(74) *Attorney, Agent, or Firm* — Westerman, Hattori, Daniels & Adrian, LLP

(57) ABSTRACT

An exercise training apparatus attached to a trainee who performs a body exercise training, includes movable bodies, actuators, sensors and a processor. The movable bodies each having a fixed member which a part of a trainee's body is fixed to and exercising a trainee's extremities by rotating around shafts, respectively. The sensors each detecting a physical quantity that changes depending on force applied to
(Continued)

the fixed members by a trainee. The processor, in response to a detection of a predetermined change in a physical quantity by the sensors, driving the actuators, rotating the movable bodies in a first direction and successively rotating the movable bodies in a second direction opposite to the first direction.

16 Claims, 7 Drawing Sheets

(52) U.S. Cl.
CPC ..... *A61H 2201/0176* (2013.01); *A61H 2201/1215* (2013.01); *A61H 2201/1276* (2013.01); *A61H 2201/1635* (2013.01); *A61H 2201/1671* (2013.01); *A61H 2201/5007* (2013.01); *A61H 2201/5028* (2013.01); *A61H 2201/5046* (2013.01); *A61H 2201/5069* (2013.01); *A63B 21/00178* (2013.01)

(58) Field of Classification Search
CPC .... A61H 2201/1671; A61H 2201/5046; A61H 2201/1215; A61H 2201/0176; A61H 2201/0157; A61H 2201/5069; A61H 2201/5028; A63B 21/00178
See application file for complete search history.

(56) References Cited

FOREIGN PATENT DOCUMENTS

| | | | |
|---|---|---|---|
| JP | 2006-095066 | A | 4/2006 |
| JP | 2007-143761 | A | 6/2007 |
| JP | 2007-520311 | A | 7/2007 |
| JP | 3140558 | U | 3/2008 |
| JP | 2010-201111 | A | 9/2010 |
| JP | 2010-207620 | A | 9/2010 |
| JP | 2010-240285 | A | 10/2010 |
| JP | 2011-193941 | A | 10/2011 |
| WO | 2005/074371 | A2 | 8/2005 |

OTHER PUBLICATIONS

International Search Report dated Jun. 11, 2013 issued in corresponding application No. PCT/JP2013/062932.
Office Action dated Feb. 14, 2017, issued in counterpart Japanese Patent Application No. 2014-514733, with English translation. (6 pages).

* cited by examiner

EXERCISE TRAINING APPARATUS

TECHNICAL FIELD

The present invention relates to an exercise training apparatus for people to train extremity movements and to improve paralysis by moving their extremities.

BACKGROUND ART

For people who have become unable to freely move their extremities due to damage of muscles, nerves or brain, a rehabilitation of moving extremities is effective in order to recover extremity movements or to improve paralysis. A therapist can constantly stay by a trainee's side during a rehabilitation. However, therapists are limited in number, and to reduce burdens on therapists, implements and apparatuses which allow trainees to independently work on their rehabilitation are in demand. Embodiments thereof are described in Patent Literatures 1 to 4.

An apparatus intended for trainees with hemiparetic upper extremity is described in Patent Literature 1. This apparatus controls a left grip-to be held in a trainee's left hand and a right grip-to be held in the trainee's right hand so as to make the left grip and the right grip position symmetrically, and moves a paralyzed hand in conformity to the moves of a healthy hand, thereby moving the healthy hand and the paralyzed hand in the mirror symmetry.

With this apparatus, there is a premise that a paralyzed hand is transitively moved entirely, however, there is a finding that depending on the condition of a paralyzed hand, voluntary movement recovers better by exercising, triggered by spontaneous movement of the paralyzed hand. (e.g., Non-Patent Literature 1). Contrary to this, an apparatus that transitively moves a trainee's arm by using a biological signal that occurs when the trainee moves his/her arm as a trigger, is disclosed in Patent Literatures 2 to 4.

CITATION LIST

Patent Literature

Patent Literature 1: Japanese Unexamined Patent Application Publication No. 2010-201111

Patent Literature 2: Japanese Unexamined Patent Application Publication No. 2011-193941

Patent Literature 3: Japanese Unexamined Patent Application Publication No. 2010-240285

Patent Literature 4: Japanese Unexamined Patent Application Publication No. 2010-207620

Non-Patent Literature

Non-Patent Literature 1: Neural Substrates for the Motivational Regulation of Motor Recovery after Spinal-Cord Injury. PloS One, September 2011, Vol. 6, Issue 9, e24854.

SUMMARY OF INVENTION

Technical Problem

However, with the apparatuses in Patent Literatures 2 to 4, not only do the apparatuses require a sensor for detecting a biological signal, which complicates the structures of the apparatuses, but they also require the work of attaching a sensor to a trainee, which disables efficient trainings.

The present invention has been made in view of the above circumstances, and an object thereof is to provide an exercise training apparatus that lets a trainee to exercises by using a trainee's spontaneous movements as a trigger and without using a sensor for detecting a biological signal.

Solution to Problem

To accomplish the above object, the present invention provides an exercise training apparatus attached to a trainee who performs a body exercise training, the exercise training apparatus comprising: a movable body having a fixed member which a part of the trainee's body is fixed to, and rotating around a shaft and exercising the trainee's extremity; an actuator giving rotational force to the movable body; a change detecting means detecting a physical quantity that changes depending on force applied to the fixed members by the trainee; and a controlling means that, in response to a detection of a predetermined change in the physical quantity by the change detecting means, drives the actuators, rotates the movable body in a first direction and successively rotates the movable body in a second direction opposite to the first direction.

In the exercise training apparatus according to the present invention, it is preferable that the change detecting means be that which detects a rotation angle of the movable body.

In the exercise training apparatus according to the present invention, it is preferable that a human body contact detecting portion be equipped for detecting that the part of the trainee's body is in contact with the fixed member.

In the exercise training apparatus according to the present invention, it is preferable that the controlling means drive the actuators and rotate the movable body, which has started rotating in the first direction, to a preset rotation angle before rotating the movable body in the second direction.

In the exercise training apparatus according to the present invention, it is preferable that the controlling means drives the actuator and rotate the movable body at a predetermined angular speed.

In the exercise training apparatus according to the present invention, it is preferable that the fixed member be a holding part that is to be held by the trainee.

In the exercise training apparatus according to the present invention, it is preferable that the movable body singly arranged one on the left and one on the right, the respective movable bodies having one said actuator and one said change detecting means connected thereto; the holding part having a left holding part and a right holding part, the left holding part to be held in the trainee's left hand being provided to the left movable body, the right holding part to be held in the trainee's right hand being provided to the right movable body, wherein the left movable body flexes or extends the trainee's left wrist by rotating, and the right movable body flexes or extends the trainee's right wrist by rotating.

In the exercise training apparatus according to the present invention, it is preferable that the controlling means starts driving the two actuators and rotate both the left movable body and the right movable body in response to a detection of the predetermined change in the physical quantity by either the change detecting means connected to the left movable body or the change detecting means connected to the right movable body.

In the exercise training apparatus according to the present invention, it is preferable that the controlling means determines a rotational area A of the left movable body and a rotational area B of the right movable body, rotates the left and right movable bodies, which have started rotating due to the actuators, in symmetric directions, and, by adjusting drive level of the two actuators, synchronizes a cycle of the left movable body's reciprocating motion of the rotational area A and a cycle of the right movable body's reciprocating motion of the rotational area B.

In the exercise training apparatus according to the present invention, it is preferable that the controlling means rotates the left and right movable bodies, which have started rotating due to the actuators, in symmetric directions at an equal angular speed.

Advantageous Effects of Invention

According to the exercise training apparatus of the present invention, the exercise training apparatus includes the change detecting means for detecting a physical quantity that changes depending on force applied to the fixed members by the trainee and the controlling means that, in response to a detection of a predetermined change in the physical quantity by the change detecting means, drives the actuators, rotates the movable body in a first direction. Therefore, the exercise training apparatus does not require a sensor for detecting a biological signal, which simplifies the structure of the exercise training apparatus. Also, since there is no need to attach a sensor to a trainee, it is easy for a trainee to be fitted with the exercise training apparatus.

Moreover, since the controlling means rotates the movable body in the first direction and successively rotates the movable body in a second direction opposite to the first direction, the exercise training apparatus enables a trainee's efficient exercise training.

DESCRIPTION OF EMBODIMENTS

Next, in order to better understand the present invention, embodiments of the present invention will be described with reference to the accompanying drawings.

Figure 1:
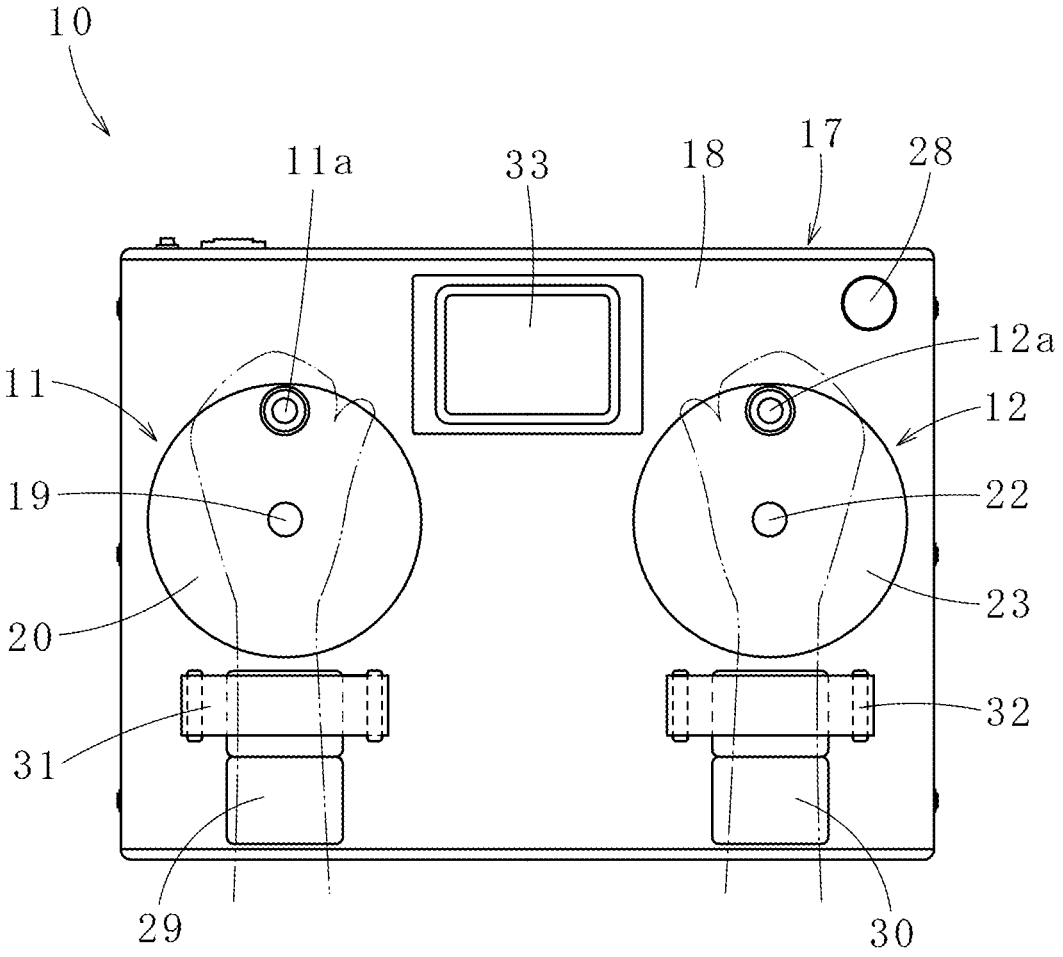
FIG. 1 is a plan view of an exercise training apparatus according to one embodiment of the present invention.
Figure 2:
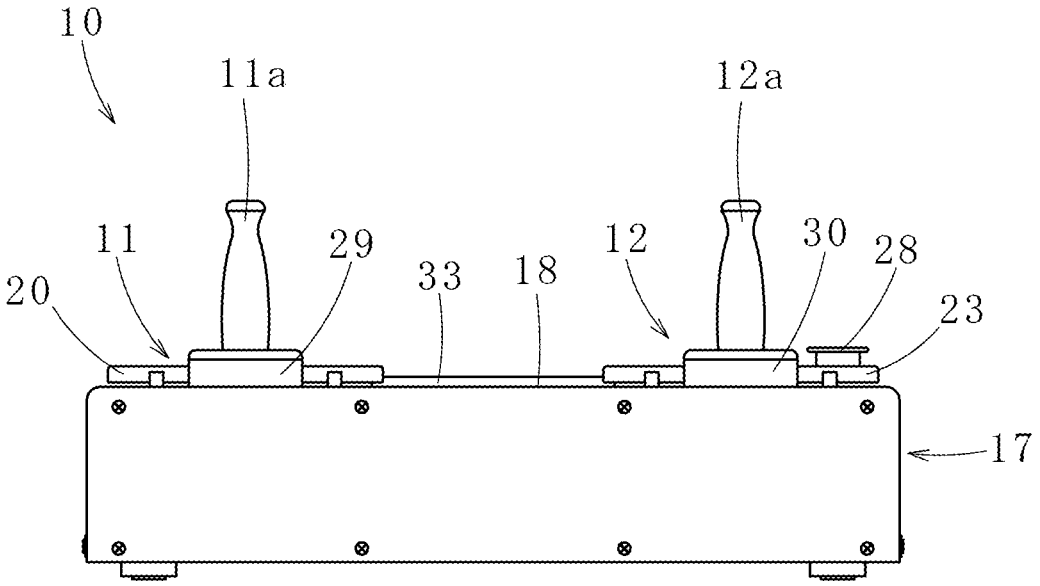
FIG. 2 is a front view of the exercise training apparatus.
Figure 3:
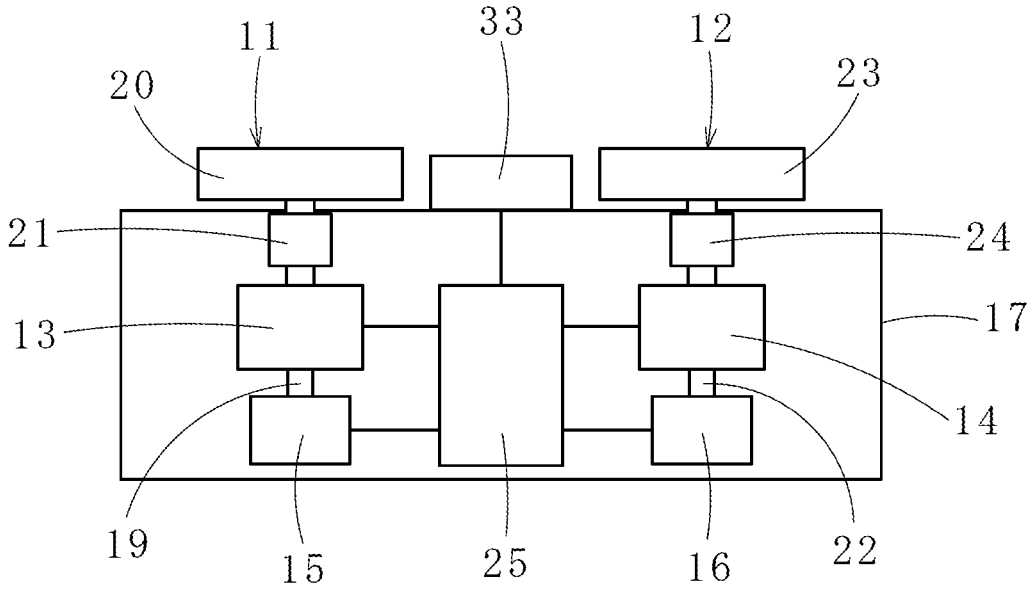
FIG. 3 is a schematic view of the exercise training apparatus.

As illustrated in FIGS. 1 to 3, an exercise training apparatus 10 according to one embodiment of the present invention is attached to a trainee who performs a body exercise training. The exercise training apparatus 10 includes movable bodies 11, 12, motors (an example of an actuator) 13, 14, and change detecting means 15, 16, the movable bodies 11, 12 respectively having fixed members 11*a*, 12*a* which parts of a trainee's body are respectively fixed to, and exercising a trainee's extremities by rotating, the motors 13, 14 giving rotational force to the movable bodies 11, 12, respectively, the change detecting means 15, 16 detecting a physical quantity that changes depending on each force applied by a trainee to the fixed members 11*a*, 12*a*, respectively, wherein the exercise training apparatus 10 moves a trainee's extremities by rotating the movable bodies 11, 12 by using the trainee's spontaneous exercises as a trigger. Detailed descriptions will be given hereunder.

The exercise training apparatus 10, as illustrated in FIGS. 1 to 3, has a boxlike casing 17, and the movable bodies 11, 12 are arranged on the left and right on a top board 18 of the casing 17.

The movable body 11 (left movable body) has a circular turntable 20 and the fixed member 11*a*, the turntable 20 being arranged horizontally and having a shaft 19 connected at the center thereof, the fixed member 11*a* being fixed to and erecting on the turntable 20.

The shaft 19 is, as illustrated in FIG. 3, arranged along a vertical direction, and one end is connected to the turntable 20 and the other end is arranged inside the casing 17. Since the shaft 19 is rotatably supported by a bearing block 21 fixed to the casing 17, the movable body 11 is rotatable around the shaft 19.

The fixed member 11*a* is a left holding part (more specifically, a left grip) that is provided to the movable body 11 and is held in a trainee's left hand. As illustrated in FIGS. 1 and 2, the fixed member 11*a* is vertically long, formed extending upward from the turntable 20 and is fixed to the turntable 20 at a position away from the center of the turntable 20. In this embodiment, the fixed member 11*a* is fixed to the turntable 20 in the area near an outer edge of the turntable 20.

The movable body 12 (right movable body) existing on the right side of the movable body 11 has the same structure as that of the movable body 11, and has a circular turntable 23 and the fixed member 12*a*, the turntable 23 being arranged horizontally and having a connected shaft 22, the fixed member 12*a* being fixed to and erecting on the turntable 23. In this embodiment, the fixed member 12*a* is a right holding part (more specifically, a right grip) provided to the movable body 12 and to be held in a trainee's right hand.

The shaft 22 is, as illustrated in FIG. 3, arranged along a vertical direction, and one end is connected to the turntable 23 and the other end is arranged inside the casing 17.

Since a bearing block 24 rotatably supporting the shaft 22 is fixed inside the casing 17, the movable body 12 is rotatable around the shaft 22.

As illustrated in FIG. 1, the fixed member 12*a* is the same as the fixed member 11*a* in terms of the following points: the fixed member 12*a* is formed extending upward from the turntable 23; and the fixed member 12*a* is fixed to the turntable 23 at a position away from the center of the turntable 23.

The shaft 19 of which one end is fixed to the movable body 11, as illustrated in FIG. 3, has the motor 13 connected thereto. The motor 13 is arranged inside the casing 17, and is capable of giving rotational force to the movable body 11 through the shaft 19.

The motor 13 has a controlling means 25 connected thereto, and the controlling means 25 sends a command signal to the motor 13 in order to drive the motor 13. The controlling means 25 can be configured, for example, by a microcomputer.

The change detecting means 15 connected to the controlling means 25, is attached to the shaft 19. In this embodiment, the change detecting means 15 is a position detecting means that detects a rotation angle of the movable body 11, and more specifically, the change detecting means 15 is a rotary encoder. The change detecting means 15 is provided inside the casing 17, detects a rotation angle of the movable body 11 from a rotation of the shaft 19, and continuously sends detection results thereof to the controlling means 25 as rotation angle information. Therefore, the controlling means 25 can maintain a state of constantly detecting a rotation angle of the movable body 11.

The movable body 11, under a condition where a trainee's left hand is holding the fixed member 11*a* and is fixed to the fixed member 11*a*, flexes (palmer flexes) or extends (dorsiflexes) the trainee's left wrist by rotating around the shaft 19.

The shaft 22 of which one end is fixed to the movable body 12 also has the motor 14 connected thereto just like the shaft 19. The motor 14 is arranged inside the casing 17, and is capable of giving rotational force to the movable body 12 through the shaft 22.

The motor 14 is connected to the controlling means 25, starts driving by the command signals from the controlling means 25, and rotates the movable body 12 around the shaft 22.

The change detecting means 16 connected to the controlling means 25, is attached to the shaft 22. In this embodiment, the change detecting means 16 is, as with the change detecting means 15, a position detecting means that detects a rotation angle of the movable body 12, and more specifically, the change detecting means 16 is a rotary encoder. The change detecting means 16 is arranged inside the casing 17, detects a rotation angle of the movable body 12 from a rotation of the shaft 22, and continuously sends detection results thereof to the controlling means 25 as rotation angle information.

The movable body 12, under a condition where a trainee's right hand is holding the fixed member 12*a* and is fixed to the fixed member 12*a*, flexes or extends the trainee's right wrist by rotating around the shaft 22.

In this embodiment, a servomotor in which the motor 13 and the change detecting means 15 are integrated, and another servomotor in which the motor 14 and the change detecting means 16 are integrated are used.

As illustrated in FIGS. 1 and 2, an emergency stop button 28, an armrest pad 29 and an armrest pad 30 are fixed on the top board 18 of the casing 17, the emergency stop button 28 forcibly stopping the operating motors 13, 14, the armrest pad 29 being arranged near the turntable 20, the armrest pad 30 being arranged near the turntable 23.

The respective armrest pads 29, 30 are for a trainee to put his/her left arm and right arm on. A trainee puts his/her left forearm on the armrest pad 29 and holds the fixed member 11*a* in his/her left hand, and puts his/her right forearm on the armrest pad 30 and holds the fixed member 12*a* in his/her right hand.

The top board 18 of the casing 17 is also provided with a belt 31 and a belt 32, the belt 31 fixing a trainee's left forearm put on the armrest pad 29, the belt 32 fixing a trainee's right forearm put on the armrest pad 30.

The left forearm and right forearm of a trainee's are fixed to the casing 17 by the belts 31, 32, respectively. Thus, a trainee whose left forearm and right forearm are fixed by the belts 31 and 32, respectively, has his/her left wrist bent or extended by the rotational movements of the movable body 11, and has his/her right wrist flexed or extended by the rotational movements of the movable body 12.

Belts 31, 32 are omitted in FIG. 2.

Additionally, as illustrated in FIGS. 1 and 3, the top board 18 of the casing 17 is provided with a touch panel 33 connected to the controlling means 25. A trainee or a therapist can configure necessary settings for performing the trainee's wrist exercise training by inputting from the touch panel 33.

When a trainee is performing his/her wrist exercise training, the touch panel 33 displays the status of the exercise training.

A wrist exercise training is performed after determining movement ranges of left and right hands and speeds of the movements thereof.

A movement range of a left hand is determined by setting a desired rotation angle to flex the left wrist and a desired rotation angle to extend the left wrist, and a movement range of a right hand is determined by setting a desired rotation angle to flex the right wrist and a desired rotation angle to extend the right wrist. When a mode for determining the motion ranges of left and right hands are selected on the touch panel 33, the motors 13, 14 become activated and rotate the turntables 20, 23. Then, as illustrated in FIG. 1, the motors 13, 14 arrange the fixed member 11*a* at a position farthest from a left wrist in a state of being extended straight, and arrange the fixed member 12*a* at a position farthest from a right wrist in a state of being extended straight.

Figure 4:
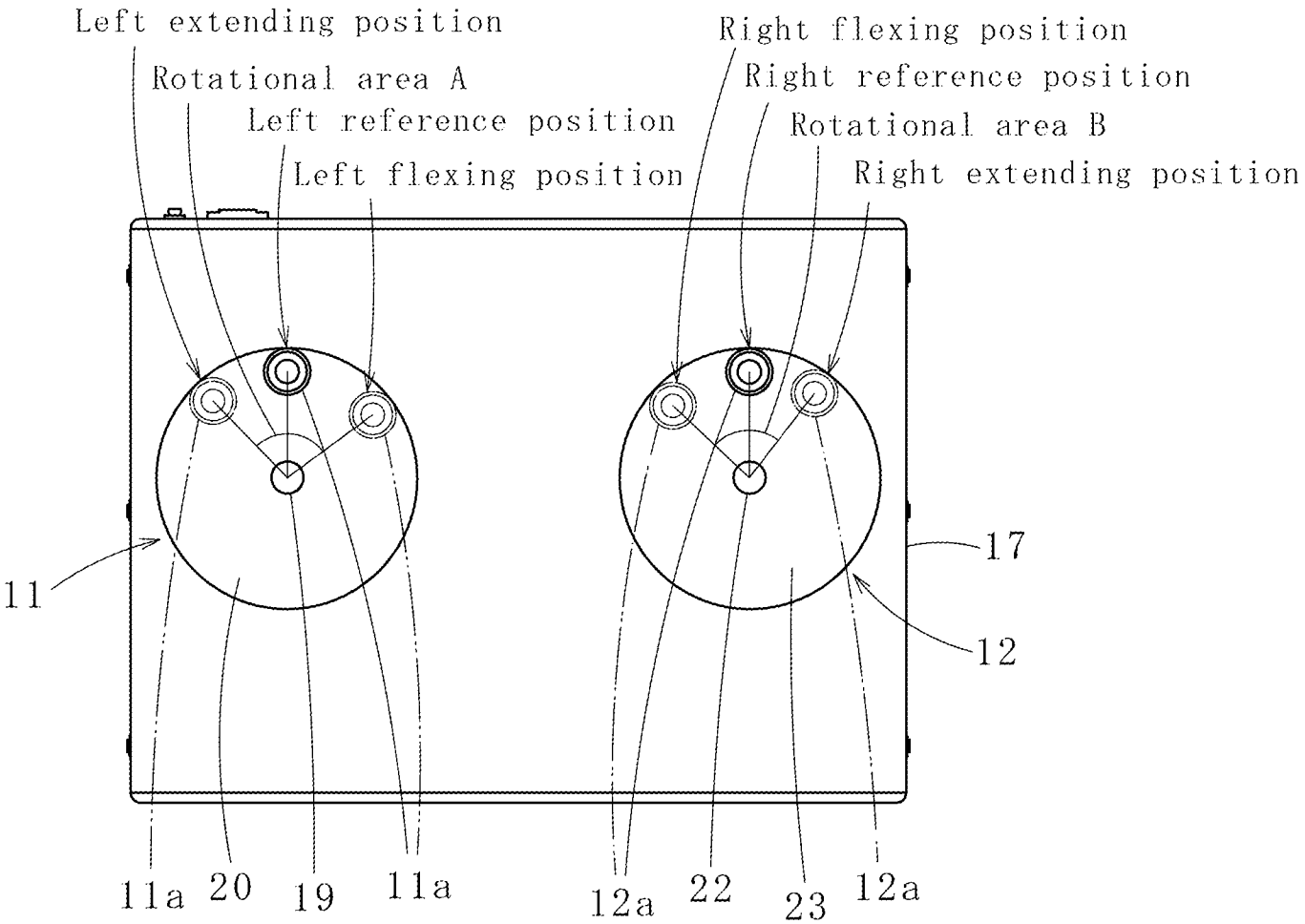
FIG. 4 is an explanatory diagram illustrating rotational areas of movable bodies.

In this embodiment, as illustrated in FIG. 4, the position of the fixed member 11*a* and the position of the fixed member 12*a* are referred as a left reference position and a right reference position, respectively.

A trainee keeps himself/herself avoiding from touching the fixed members 11*a*, 12*a* until the turntables 20, 23 rotate and the fixed member 11*a* and the fixed member 12*a* become arranged at the left reference position and the right reference position, respectively.

A buzzer goes off after the fixed members 11*a*, 12*a* each become arranged at the reference positions. After the buzzer goes off, a trainee holds the fixed member 11*a* in his/her left hand and the fixed member 12*a* in his/her right hand, and further fixes his/her left forearm and right forearm each by the belts 31, 32.

After the buzzer goes off, the motors 13, 14 become free, and the turntables 20, 23 go into a state of being freely rotatable.

Figure 5A:
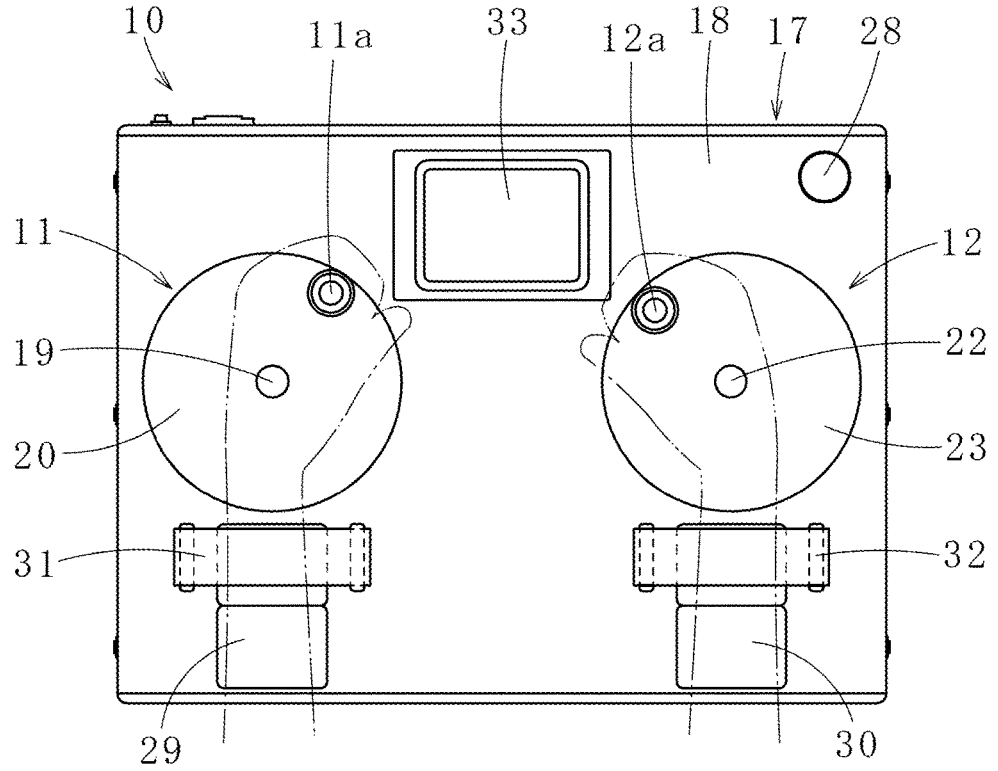
FIGS. 5(A) and 5(B) are explanatory diagrams illustrating operations of the exercise training apparatus.

Next, the trainee or the therapist, as illustrated in FIG. 5(A), flexes his/her left wrist to a rotation angle desired for the trainee's left wrist to be flexed at in the exercise training, and pushes a button to decide the rotation angle on the touch panel 33. A rotation angle desired for a trainee's left wrist to be flexed at is determined by this operation. In this embodiment, the position of the fixed member 11*a* at this point is regarded as a left flexing position as illustrated in FIG. 4.

By the same operation as the one performed to determine the left flexing position, rotation angles desired for a trainee's left wrist to be extended at and for his/her right wrist to be flexed and extended at are determined. In this embodiment, as illustrated in FIG. 4, a position of the fixed member 11*a* at the time of flexing a left wrist to a rotation angle desired for extending, a position of the fixed member 12*a* at the time of flexing a right wrist to a rotation angle desired for flexing, and a position of the fixed member 12*a* at the time of flexing his/her right wrist to a rotation angle desired for extending are regarded as a left extending position, a right flexing position, and a right extending position, respectively.

The controlling means 25 memorizes a rotational area A of the movable 11 body and a rotational area B of the movable body 12 in addition to a decided left flexing position, left extending position, right flexing position and right extending position, the rotational area A of the movable body 11 being determined by the left flexing position and the left extending position, the rotational area B of the movable body 12 being determined by the right flexing position and the right extending position.

Order for deciding a left flexing position, left extending position, right flexing position, and right extending position is depends on a program stored in the controlling means 25. Additionally, if a left reference position and a right reference position are 0 degree positions, in this embodiment, the left flexing position, left extending position, right flexing position and right extending position can be set at positions ranging from −90 degrees to +90 degrees, going beyond the 0 degree positions.

Once the left flexing position, left extending position, right flexing position and right extending position are determined, a therapist or a trainee determines a speed of the wrist exercise training by an input operation to the touch panel 33. The controlling means 25 sets angular speeds of the movable bodies 11, 12 based on a determined speed of the exercise training. In this embodiment, a speed of an exercise training is selectable in seconds within a range of 1 to 4 seconds. When a speed of T seconds is selected, the controlling means 25 calculates an angular speed of the movable body 11 at which the fixed member 11*a* reciprocates the rotational area A once in T seconds and an angular speed of the movable body 12 at which the fixed member 12*a* reciprocates the rotational area B once in T seconds.

The number of wrist exercise trainings to be performed can also be set by operating the touch panel 33. When a wrist exercise training starts, the controlling means 25 displays a number, which is calculated by subtracting the number of trainings actually performed from a set number, on the touch panel 33. Once the set number of exercise trainings is performed, the controlling means 25 stops the operations of the motors 13, 14.

A trainee completes fitting for performing an exercise training by holding the fixed members 11*a* and 12*a* in his/her left and right hands, respectively, and fixing his/her left and right forearms to the belts 31 and 32, respectively. Therefore, a trainee can finish the fitting process easily and in a short amount of time.

In this embodiment, there are programs for performing three types of exercise trainings stored in the controlling means 25, and a therapist or a trainee can select a mode for performing a training by input operations on the touch panel 33.

The first one is a transitive mode that transitively flexes a trainee's wrists. When the transitive mode starts, a trainee does not move his/her left hand or right hand by using his/her own muscles. Flexing exercises of the left hand and right hand are performed by the movable bodies 11, 12 rotated by drive of the motors 13, 14.

In the transitive mode, the motors 13, 14 start driving by receiving command signals from the controlling means 25, and rotate the movable bodies 11, 12 at preset angular speeds (predetermined angular speeds). The movable body 11, due to the drive of the motor 13, rotates such that the fixed member 11*a* continuously reciprocates the rotational area A a predetermined number of times, and the movable body 12, due to the drive of the motor 14, rotates such that the fixed member 12*a* continuously reciprocates the rotational area B a predetermined number of times.

Here, the respective fixed members 11*a*, 12*a* may be provided with an unillustrated contact-type sensor (one example of a human body contact detecting portion), and the controlling means 25 may drive the motors 13, 14 only when the controlling means 25 is detecting, by this contact-type sensor, that hands (a part of a body) of a trainee's are in contact with the fixed member 11*a* and the fixed member 12*a*. This can prevent the motors 13, 14 from driving to rotate the movable bodies 11, 12 under a condition where a trainee is not holding the fixed members 11*a*, 12*a*.

Both the second one, an active assistance mode 1, and the third one, an active assistance mode 2, are modes that use rotations of the movable body 11 or the movable body 12 due to force given by a trainee as a trigger and start driving the motors 13, 14.

In the active assistance modes 1 and 2, the controlling means 25, by receiving rotation angle information from the change detecting means 15, 16 while the motors 13, 14 are at rest, detects that the movable bodies 11, 12 have been rotated by a trainee, drives the motors 13, 14 and starts rotating the movable bodies 11, 12.

When the controlling means 25 detects that one of the movable bodies 11 and 12 has been rotated due to force given by a trainee, the controlling means 25 starts driving the motors 13, 14 and rotates both of the movable bodies 11, 12.

The setting enables to make the decision of whether to use the movable body 11 or 12 as a trigger for starting the drive of the motors 13, 14. A therapist or a trainee determines the movable body to be a trigger in accordance with the conditions of the trainee's left and right hands.

In the controlling means 25, it is possible to set the degrees (angle) by which the fixed member 11*a* or the fixed member 12*a* needs to be moved in order to start driving the motors 13, 14. A value D ranging from 5 to 25 degrees is set in this embodiment.

In the active assistance modes 1 and 2, the motors 13, 14 start to be driven once the movable body (movable body 11 or movable body 12) determined as a trigger tunes D degrees while the motors 13, 14 are at rest. The controlling means 25 drives the motor such that one movable body acting as a trigger rotates in a direction rotated by a trainee, and also rotates the other movable body by driving the motor. At this point, the movable bodies 11, 12 rotate in symmetric directions.

Therefore, the controlling means 25 drives the motors 13, 14 in response to a detection, by the change detecting means (the change detecting means 15 or the change detecting means 16), of a predetermined change in a physical quantity (in this embodiment, a rotation angle of a movable body) due to force applied by a trainee to the fixed member (the fixed member 11*a* or the fixed member 12*a*).

Specifically, when the movable body 11 is determined as a trigger and the movable body 11 is rotated in a direction that flexes a trainee's left hand (the first direction), by the movable body 11's being rotated by D degrees, the motor 13, as illustrated in FIG. 5(A), rotates the movable body 11 in the flexing direction until the fixed member 11*a* is arranged at the left flexing position. The controlling means 25 starts driving the motor 14 at the same time as when starting driving the motor 13, and rotates the movable body 12 in a direction that makes the movable body 12 symmetrical to the movable body 11, i.e., a direction that flexes the trainee's right hand (the first direction).

The movable bodies 11, 12 rotate until the fixed members 11*a*, 12*a* are located at the left flexing position and the right flexing position, respectively. Then, the controlling means 25 successively inverts the rotation directions of the movable bodies 11, 12 to make the movable body 11 rotate in a direction that extends the trainee's left hand (the second direction) and to make the movable body 12 rotate in a direction that extends the trainee's right hand (the second direction). In this embodiment, between the fixed members 11*a* and 12*a*, one that reaches a left flexing position or a right flexing position first temporarily stops until the other one reaches a left flexing position or a right flexing position.

Then, the fixed members 11*a*, 12*a* simultaneously start moving in directions that extend a trainee's hands.

In the active assistance mode 1 and the active assistance mode 2, there is a difference in rotation ranges of the movable bodies 11, 12 rotated by one operation of the motors 13, 14.

In the active assistance mode 1, after a movable body set as a trigger was rotated by D degrees, the motors 13, 14 are kept driven until the fixed members 11*a* and 12*a* respectively finish reciprocating the rotational area A once and the rotational area B once, and the motors 13, 14 rest.

Figure 5B:
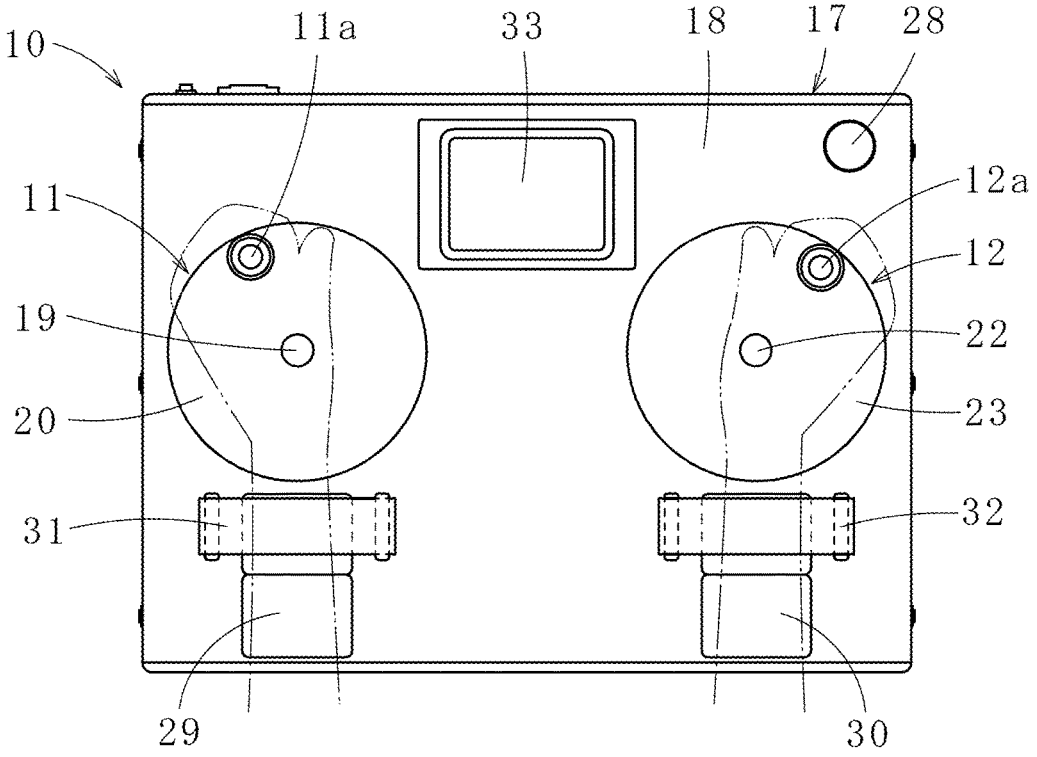

Specifically, the motor 13 operates, regarding the following as one behavior: the fixed member 11*a*'s moving from a position rotated by D degrees in the flexing direction to a left flexing position (see FIG. 5(A)); and the fixed member 11*a*'s moving to a left extending position (see FIG. 5(B)) and then going back to the reference position, and the motor 13 rests. The motor 14 operates, regarding the following as one behavior: the fixed member 12*a*'s moving from a reference position to a right flexing position and moving to a right extending position and going back to the reference position, and the motor 14 rests.

Thus, the movable bodies 11, 12 having started rotating by the drive of the motors 13, 14 rotate in symmetric directions, exercising a trainee's left and right hands in a symmetrical direction. There is a finding that moving left and right hands in a symmetrical direction is efficacious in improving the effects of a trainee's rehabilitation.

The motors 13, 14 in a resting state wait for a movable body determined as a trigger to become re-rotated by D degrees in the flexing direction, and the motors 13, 14 re-start the drive thereof.

In this embodiment, the controlling means 25 keeps a cycle of the movable body 11's reciprocating a rotational area A once in line with a cycle of the movable body 12's reciprocating a rotational area B once by adjusting the drive levels of the motors 13, 14, i.e., angular speeds of output shafts of the motors 13, 14. When an angular difference between a left flexing position and a left extending position (hereinafter also referred to as "angular width of a rotational area A") and an angular difference between a right flexing position and a right extending position (hereinafter also referred to as "angular width of a rotational area B") are the same, angular speeds of the output shafts of the motors 13, 14 become equal. When an angular width of a rotational area A and an angular width of a rotational area B are different, angular speeds of the output shafts of the motors 13, 14 result in different values.

In contrast, in the active assistance mode 2, the motor 13 starts the drive thereof after a movable body determined as a trigger was rotated by D degrees in the flexing direction. Then, the motor 13 operates, regarding the following as one behavior: the fixed member 11*a*'s moving from a position rotated by D degrees in the flexing direction to a left flexing position and going back to a reference position, and the motor 13 rests. The motor 14 having started the drive thereof at the same time as the motor 13 operates, regarding the following as one behavior: the fixed member 12*a*'s moving from a reference position to a right flexing position and going back to the reference position, and the motor 14 goes into a resting state.

The motor 13 also starts the drive thereof when a movable body determined as a trigger was rotated by D degrees in the extending direction. The motor 13 operates, regarding the following as one behavior: the fixed member 11*a*'s moving from a position rotated by D degrees in the extending direction to a left extending position and going back to a reference position. The motor 14 having started the drive thereof at the same time as the motor 13 operates, regarding the following as one behavior: the fixed member 12*a*'s moving from a reference position to a right extending position and going back to the reference position.

Therefore, in the active assistance mode 2, as with the active assistance mode 1, the movable bodies 11, 12 having started rotating due to the drive of the motors 13, 14 rotate in symmetric directions.

In this embodiment, when an angular width of a rotational area A and an angular width of a rotational area B are different, an angular speed of the movable body 11 rotated by the drive of the motor 13 and an angular speed of the movable body 12 rotated by the drive of the motor 14 result in different values. However, by changing a program installed in the controlling means 25, the movable bodies 11, 12 can be made to rotate in symmetrical directions t at an equal angular speed.

In this case, one movable body that has reached a flexing position (a left flexing position or a right flexing position) first temporarily stops until the other movable body reaches a flexing position, and starts rotational movements to head from the flexing position to a reference position at the same timing as the other movable body. Then, by the same control, the movable bodies 11, 12 are adjusted to start rotational movements to head from extending positions (a left extending position or a right extending position) to reference positions at the same timing. This enables a cycle of the movable body 11's reciprocating a rotational area A and a cycle of the movable body 12's reciprocating a rotational area B to be kept in line with each other.

Also, the controlling means 25 is capable of memorizing a plurality of patterns of left flexing positions, left extending positions, right flexing positions and right extending positions set at the time of performing wrist exercise trainings and speeds, etc. of exercise trainings. Therefore, it is possible to easily re-create the patterns set in the past.

Descriptions have been given hereinbefore on the exercise training apparatus 10 that trains the flexing and extending movements of wrists, which are one example of a trainee's extremity movements. However, the point of the present invention is that, a position detecting means detects that a movable body has been moved by a trainee while the actuators have been at rest, and the detection is the trigger which drives the actuators. Consequently, the present invention can also be applied to exercise trainings of other extremities such as pronation and supination of a forearm, adduction, abduction, internal rotation and external rotation of a shoulder joint, flexing and extending of an elbow joint, and dorsiflexion and plantar flexion of a foot joint.

Figure 6:
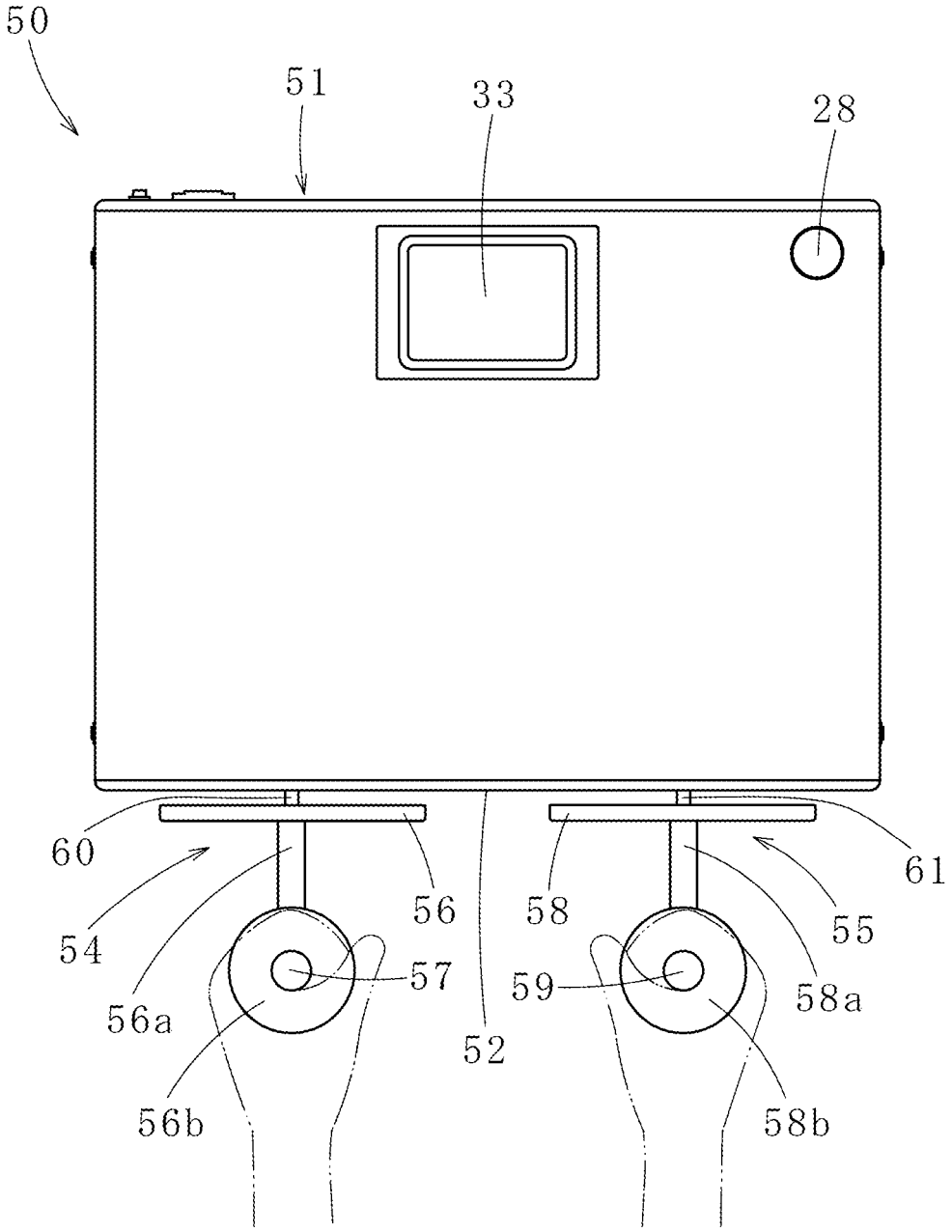
FIG. 6 is a plan view of a first variation of the exercise training apparatus.

For example, an exercise training apparatus 50 illustrated in FIG. 6, which is a first variation of the exercise training apparatus 10, is an apparatus for performing exercise trainings of pronation and supination of forearms. Description on the exercise training apparatus 50 will be given hereinafter. Pronation and supination of a forearm are movements in which the forearm is rotated centering on the forearm, and the term "pronation" means a movement in which the forearm is rotated inward and the term "supination" means a movement in which the forearm is rotated outward. Components that are the same as those of the exercise training apparatus 10 are indicated by the same signs and detailed descriptions thereof are omitted.

The exercise training apparatus 50 has a movable body 54 and a movable body 55 arranged on the left and right, respectively, on one sidewall portion 52 of a boxlike casing 51. The movable body 54 has a circular turntable 56, a supporting bar material 56*a*, a circular plate 56*b*, and a fixed member 57, the circular turntable 56 being arranged parallel to the sidewall portion 52, the supporting bar material 56*a* of which one end is fixed at the center of the turntable 56 being arranged in a horizontal direction, the circular plate 56*b* on which a trainee's left hand is put being fixed to the supporting bar material 56*a*, the fixed member 57 of which one end is fixed at the center of the circular plate 56*b* being arranged perpendicular to the supporting bar material 56*a*. The movable body 55, as with the movable body 54, also has a circular turntable 58, a supporting bar material 58*a*, a circular plate 58*b*, and a fixed member 59, the circular turntable 58 being arranged parallel to the sidewall portion 52, the supporting bar material 58*a* of which one end is fixed at the center of the turntable 58 being arranged in a horizontal direction, the circular plate 58*b* on which a trainee's right hand is put being fixed to the supporting bar material 58*a*, the fixed member 59 of which one end is fixed at the center of the circular plate 58*b* being arranged perpendicular to the supporting bar material 58*a*.

A shaft 60 coaxially arranged with the supporting bar material 56*a* is connected to the turntable 56, and a shaft 61 coaxially arranged with the supporting bar material 58*a* is connected to the turntable 58.

The movable bodies 54, 55 rotate around the shafts 60, 61 by drive of a motor connected to the shaft 60 and drive of a motor connected to the shaft 61, respectively.

A trainee extends his/her left and right forearms from positions facing the sidewall portion 52 toward the sidewall portion 52, holds the fixed member 57 in his/her left hand with his/her left forearm positioned along the supporting bar material 56*a*, and holds the fixed member 59 in his/her right hand with his/her right forearm positioned along the supporting bar material 58*a*, and performs an exercise training of pronation and supination of his/her left and right forearms. Specifically, when a trainee, while the two motors are at rest, pronated or supinated either his/her own right forearm or left forearm and rotated a movable body determined as a trigger, the two motors start the drive and rotate the movable bodies 54, 55, which transitively pronates and supinates the trainee's left and right forearms.

Figure 7:
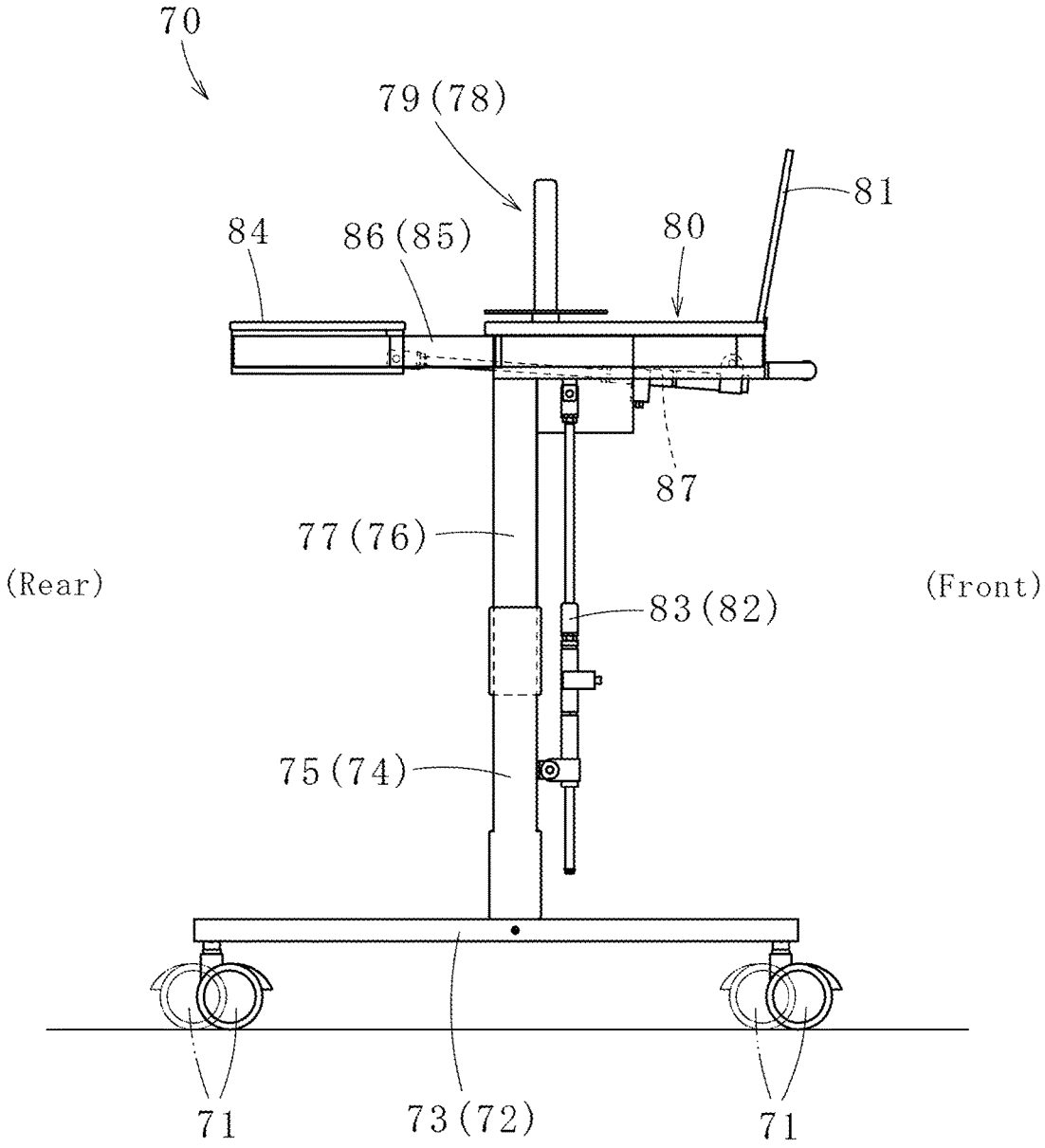
FIG. 7 is a side view of a second variation of the exercise training apparatus.

Although the exercise training apparatuses 10, 55 are designed on the premise of being pet on top of a table, etc., exercise training apparatuses are not limited to the foregoing premise. For example, an exercise training apparatus 70 illustrated in FIG. 7, which is a second variation of the exercise training apparatus 10, is provided with a plurality of casters 71 and designed to be capable of moving back and forth and side to side on a floor.

The exercise training apparatus 70 includes longitudinally long base materials 72, 73 arranged on the left and right with a space in between, the base materials 72, 73 each having casters 71 attached at the front and back thereof, the base materials 72, 73 each having lower pillar materials 74, 75 fixed thereto.

An upper pillar material 76 and an upper pillar material 77 are vertically movably connected to the lower pillar materials 74, 75, respectively, and the upper pillar materials 76, 77 support a casing 80 from underneath, the casing 80 to which two movable bodies 78, 79 are attached. In the casing 80 unillustrated motors and change detecting means are stowed and a touch panel 81 attached at the front side of the casing 80.

Between the base material 72, the lower pillar material 74 and the upper pillar material 76 that are arranged on the left and the base material 73, the lower pillar material 75 and the upper pillar material 77 that are arranged on the right, and on the underside of the casing 80, there is a space having a size large enough for a wheelchair to enter into. Therefore, a trainee can come close to the exercise training apparatus 70 with sitting on a wheelchair and go into a position for performing a wrist exercise training. Alternatively, the exercise training apparatus 70 can be brought close to a trainee sitting on a wheelchair and arranged in a position where a wrist exercise training can be performed.

In this embodiment, in order to ensure a large space on the underside of the casing 80, motors small in physical size are adopted as the motors and the casing 80 is designed to be small. If torque given to the movable bodies 78, 79 becomes insufficient due to the adoption of small motors, it is possible to give necessary torque to the movable bodies 78, 79 by connecting the motors and the movable bodies 78, 79 through a reduction gear.

Additionally, since height adjustment of the upper pillar materials 76, 77 and the casing 80 can be made by gas springs 82, 83 attached to the lower pillar materials 74, 75, respectively, the height of the casing 80 is adjustable depending on a trainee's physique.

A supporting stand 84 is provided behind the casing 80 for a trainee performing a wrist exercise training to put his/her left and right forearms on. The casing 80 and the supporting stand 84 are connected by a longitudinally long left guiding member 85 and an also longitudinally long right guiding member 86. The supporting stand 84 is capable of moving back and forth along the left guiding member 85 and the right guiding member 86, and a position of the supporting stand 84 in a longitudinal direction is adjusted depending on the lengths of a trainee's forearms.

In this embodiment, a gas spring 87 is attached to the supporting stand 84, the gas spring 87 assists the longitudinal movements of the supporting stand 84, and enables the smooth position adjustment of the supporting stand 84 in a longitudinal direction.

Descriptions on the embodiments of the present invention have been given hereinbefore, however, the present invention is not limited to the above-described forms, and changes, etc. under a condition of not departing from the scope of the present invention are all in the range of application of the present invention.

For instance, an actuator for giving rotational force to movable bodies is not limited to a motor, and may be, for example, an air cylinder.

Also, devices such as a keyboard and a mouse may be used as a device for inputting settings of exercise trainings instead of a touch panel.

Moreover, it is not mandatory to have two sets of movable bodies, change detecting means and motors. One set of a movable body, a change detecting means and a motor is enough in case of performing an exercise training on one hand.

Furthermore, a fixed member which a part of a trainee's body is fixed to is not limited to a holding part to be held by a trainee, and may be, for example, a leg cover which a trainee's leg is fitted to.

A change detecting means is not limited to a position detecting means, and may be anything that detects a physical quantity that changes due to force applied to a fixed member by a trainee. For example, a torque sensor that detects a torque may be adopted as a change detecting means, the torque generated in a movable body and changed by a trainee's applying force to a fixed member. In that case, a controlling means is designed to trigger torque's reaching a predetermined value in order to start rotation of movable bodies due to drive of motors, the torque being generated in a movable body. Additionally, when adopting that which is anything other than a position detecting means as a change detecting means, it is required to control rotation of movable bodies by providing a means for detecting rotation angles of movable bodies besides the change detecting means.

REFERENCE SIGNS LIST

10: exercise training apparatus, 11: movable body, 11*a*: fixed member, 12: movable body, 12*a*: fixed member, 13, 14: motor, 15, 16: change detecting means, 17: casing, 18: top board, 19: shaft, 20: turntable, 21: bearing block, 22: shaft, 23: turntable, 24: bearing block, 25: controlling means, 28: emergency stop button, 29, 30: armrest pad, 31, 32: belt, 33: touch panel, 50: exercise training apparatus, 51: casing, 52: sidewall portion, 54, 55: movable body, 56: turntable, 56*a*: supporting bar material, 56*b*: circular plate, 57: fixed member, 58: turntable, 58*a*: supporting bar material, 58*b*: circular plate, 59: fixed member, 60, 61: shaft, 70: exercise training apparatus, 71: caster, 72, 73: base material, 74, 75: lower pillar material, 76, 77: upper pillar material, 78, 79: movable body, 80: casing, 81: touch panel, 82, 83: gas spring, 84: supporting stand, 85: left guiding member, 86: right guiding member, 87: gas spring

The invention claimed is:

1. An exercise training apparatus, comprising:

a movable body having a surface and a fixed member extending from the surface, the movable body being rotatable about a shaft, and the fixed member being adapted to be held by a hand to rotate the movable body about the shaft;

an actuator providing a rotational force to rotate the movable body about the shaft;

a sensor detecting a rotation of the movable body about the shaft and generating rotation information on a quantity of the rotation of the movable body about the shaft; and a processor configured to:

receive the rotation information from the sensor;

determine, based on the rotation information, when a predetermined amount of change in the rotation of the movable body about the shaft has occurred without the rotational force being provided by the actuator to rotate the movable body; and when the predetermined amount of change in the rotation of the movable body has been determined, control the actuator to provide the rotational force to rotate the movable body about the shaft alternately in a first direction and in a second direction opposite to the first direction.

2. The exercise training apparatus according to claim 1, wherein the sensor is a rotary encoder.

3. The exercise training apparatus according to claim 1, wherein the sensor is a torque sensor.

4. The exercise training apparatus according to claim 1, further comprising a contact sensor disposed on the fixed member.

5. The exercise training apparatus according to claim 1, wherein the processor is further configured to control the actuator to provide the rotational force to rotate the movable body for a preset rotation angle in the first direction before alternating to rotate the movable body in the second direction.

6. The exercise training apparatus according to claim 1, wherein the processor is further configured to control the actuator to provide the rotational force to rotate the movable body at a predetermined angular speed.

7. The exercise training apparatus according to claim 1, further comprising:

a casing housing the actuator, the sensor, and the processor, with the shaft extending from within the casing to the movable body disposed on a surface of the casing;

a pillar supporting the casing; and a movable base on which the pillar is supported.

8. An exercise training apparatus, comprising:

a first movable body and a second movable body, each of the movable bodies having a surface and a fixed member extending from the surface, the first movable body being rotatable about a first shaft, the second movable body being rotatable about a second shaft, the fixed member of the first movable body being adapted to be held by a left hand to rotate the first movable body about the first shaft, and the fixed member of the second movable body being adapted to be held by a right hand to rotate the second movable body about the second shaft;

a first actuator providing a rotational force to rotate the first movable body about the first shaft;

a second actuator providing a rotational force to rotate the second movable body about the second shaft;

a first sensor detecting a rotation of the first movable body about the first shaft and generating first rotation information on a quantity of the rotation of the first movable body about the first shaft;

a second sensor detecting a rotation of the second movable body about the second shaft and generating second rotation information on a quantity of the rotation of the second movable body about the second shaft; and a processor configured to:

receive the first and second rotation information respectively from the first and second sensors;

determine, based on the first rotation information, when a predetermined amount of change in the rotation of the first movable body about the first shaft has occurred without the rotational force being provided by the first actuator to rotate the first movable body;

determine, based on the second rotation information, when the predetermined amount of change in the rotation of the second movable body about the second shaft has occurred without the rotational force being provided by the second actuator to rotate the second movable body; and when the predetermined amount of change in the rotation of either of the first movable body or the second movable body has been determined, control the first and second actuators to provide the rotational force to respectively rotate the first and second movable bodies alternately in a first direction and in a second direction opposite to the first direction.

9. The exercise training apparatus according to claim 8, wherein at least one of the first and second sensors is a rotary encoder.

10. The exercise training apparatus according to claim 8, wherein at least one of the first and second sensors is a torque sensor.

11. The exercise training apparatus according to claim 8, further comprising a contact sensor disposed on the fixed member of at least one of the first and second movable bodies.

12. The exercise training apparatus according to claim 8, wherein the processor is further configured to control the first and second actuators to provide the rotational force to respectively rotate each of the movable bodies for a preset rotation angle in the first direction before alternating to rotate in the second direction.

13. The exercise training apparatus according to claim 8, wherein the processor is further configured to control the first and second actuators to provide the rotational force to respectively rotate each of the movable bodies at a predetermined angular speed.

14. The exercise training apparatus according to claim 8, wherein the processor is further configured to determine a rotational area A for the first movable body and a rotational area B for the second movable body, and wherein the control of the first and second actuators by the processor controls the first and second actuators to provide the rotational force to symmetrically rotate the first and second movable bodies in the first and second directions in the rotational areas A and B by adjusting a drive level of each of the first and second actuators to synchronize a cycle of rotation of the first movable body in the rotational area A with a cycle of rotation of the second movable body in the rotational area B.

15. The exercise training apparatus according to claim 8, wherein the control of the first and second actuators by the processor controls the first and second actuators to provide the rotational force to symmetrically rotate the first and second movable bodies at an equal angular speed.

16. The exercise training apparatus according to claim 8, further comprising:

a casing housing the first and second actuators, the first and second sensors, and the processor, with the first and second shafts extending from within the casing respectively to the first and second movable bodies disposed on a surface of the casing;

a pillar supporting the casing; and a movable base on which the pillar is supported.

* * * * *